US010416582B2

(12) United States Patent
Nakagawa et al.

(10) Patent No.: US 10,416,582 B2
(45) Date of Patent: Sep. 17, 2019

(54) TONER AND METHOD FOR PRODUCING TONER

(71) Applicant: CANON KABUSHIKI KAISHA, Tokyo (JP)

(72) Inventors: Yoshihiro Nakagawa, Numazu (JP); Tsutomu Shimano, Mishima (JP); Reo Tagawa, Susono (JP); Taku Shimoda, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/180,386

(22) Filed: Nov. 5, 2018

(65) Prior Publication Data

US 2019/0137900 A1 May 9, 2019

(30) Foreign Application Priority Data

Nov. 7, 2017 (JP) ..... 2017-214303
Sep. 13, 2018 (JP) ..... 2018-171955

(51) Int. Cl.
*G03G 9/08* (2006.01)
*G03G 9/087* (2006.01)

(52) U.S. Cl.
CPC ..... *G03G 9/08782* (2013.01); *G03G 9/0806* (2013.01); *G03G 9/0819* (2013.01); *G03G 9/08711* (2013.01); *G03G 9/08797* (2013.01)

(58) Field of Classification Search
CPC ..... G03G 9/08782; G03G 9/08797; G03G 9/08711
USPC ..... 430/108.4, 108.8, 111.4
See application file for complete search history.

(56) References Cited

U.S. PATENT DOCUMENTS

| | | | |
|---|---|---|---|
| 4,960,669 | A | 10/1990 | Mori et al. |
| 6,569,589 | B2 | 5/2003 | Inaba et al. |
| 8,603,712 | B2 | 12/2013 | Aoki et al. |
| 8,741,519 | B2 | 6/2014 | Watanabe et al. |
| 8,846,284 | B2 | 9/2014 | Kinumatsu et al. |
| 9,158,216 | B2 | 10/2015 | Shimano et al. |
| 9,170,509 | B2 | 10/2015 | Masuda |
| 9,377,705 | B2 | 6/2016 | Shimano et al. |
| 9,383,668 | B2 | 7/2016 | Noji et al. |
| 9,429,860 | B2 | 8/2016 | Kinumatsu et al. |
| 9,500,972 | B2 | 11/2016 | Tanaka et al. |
| 9,551,947 | B2 | 1/2017 | Hiroko et al. |
| 9,575,424 | B2 | 2/2017 | Nakagawa et al. |
| 9,599,919 | B2 | 3/2017 | Isono et al. |
| 9,658,549 | B2 | 5/2017 | Tanaka et al. |
| 9,785,071 | B2 | 10/2017 | Shimano et al. |
| 9,829,816 | B2 | 11/2017 | Tanaka et al. |
| 9,835,964 | B2 | 12/2017 | Yoshida et al. |
| 9,880,478 | B2 | 1/2018 | Shimano et al. |
| 9,904,193 | B2 | 2/2018 | Nakagawa et al. |
| 9,921,501 | B2 | 3/2018 | Mochizuki et al. |
| 9,952,523 | B2 | 4/2018 | Shimano et al. |
| 9,958,801 | B2 | 5/2018 | Tanaka et al. |
| 10,078,279 | B2 | 9/2018 | Nakagawa et al. |
| 10,101,681 | B2 | 10/2018 | Tagawa et al. |
| 10,114,303 | B2 | 10/2018 | Katsura et al. |
| 2018/0210361 | A1 | 7/2018 | Katsura et al. |
| 2018/0329320 | A1 | 11/2018 | Yoshida et al. |
| 2018/0329327 | A1 | 11/2018 | Yamawaki et al. |
| 2018/0329332 | A1 | 11/2018 | Tominaga et al. |

FOREIGN PATENT DOCUMENTS

| | | |
|---|---|---|
| JP | 5196120 | 5/2013 |
| JP | 6020458 | 11/2016 |

OTHER PUBLICATIONS

Yuji Harazaki, Tables 3-9 of "Basic Coating Science" (1986) 54-57.
U.S. Appl. No. 16/180,480, filed Nov. 5, 2018, Tsutomu Shimano.

*Primary Examiner* — Mark A Chapman
(74) *Attorney, Agent, or Firm* — Venable LLP

(57) ABSTRACT

A toner comprising: a toner particle that contains a binder resin and a wax, wherein the binder resin contains a styrene-acrylic copolymer, the content of the styrene-acrylic copolymer in the binder resin is at least 50 mass %, the wax contains a wax A, at least 15.0 mass parts of the wax A compatibilizes at 100° C. with 100 mass parts of a specific styrene—butyl acrylate copolymer, and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 μm, and the ratio of r1 to r2 is from 1.0 to 3.0.

13 Claims, No Drawings

TONER AND METHOD FOR PRODUCING TONER

BACKGROUND OF THE INVENTION

Field of the Invention

The present invention relates to a toner used to form a toner image by the development of an electrostatic latent image formed by a method such as electrophotography, electrostatic recording, and toner jet recording methods. The present invention further relates to a method for producing this toner.

Description of the Related Art

Energy savings have come to be regarded in recent years as a major technical issue for copiers, printers, and facsimile machines, and substantial reductions in the amount of heat required by an image fixing apparatus are desired. Thus, with regard to a toner, there is great need for image fixation to be made possible at lower energies, i.e., for low-temperature fixability.

One general method for improving the low-temperature fixability of the toner is to lower the glass transition temperature (Tg) with the goal of softening the binder resin that is used. However, the following, for example, occur when just a lowering of the Tg of the binder resin is brought about by itself: the generation of offset to the fixing member due to an inadequate releasability during fixing, and/or a reduction in the heat resistance during toner storage.

As a method for softening the binder resin without causing a reduction in the Tg, the addition of a plasticizer is practiced. However, the use of a plasticizer that exhibits a large plasticizing action for the binder resin is required in order to bring about a satisfactory softening of the toner during fixing. When such a plasticizer is used, the plasticizer readily outmigrates to the toner surface during storage and image defects are then produced due to blocking and reductions in the flowability.

Moreover, incorporating a wax that exhibits releasability into the toner is practiced in order to supplement the releasability during fixing. However, exudation of the wax to the toner surface during fixing is unsatisfactory when this incorporation is simply implemented by itself, and offset to the fixing member is then produced due to an inadequate releasability during fixing. Various efforts have been made in order to solve these problems.

For example, Japanese Patent No. 6,020,458 discloses a method in which, by using a special diester as a softening agent, a special range is set for the thermal characteristics of the toner and the low-temperature fixability is made to coexist in good balance with the heat-resistant storability.

With respect to toner that exhibits a large scatter in the release agent content as a function of particle size, Japanese Patent No. 5,196,120 discloses a method in which, by controlling the average dispersed particle diameters of a modified layered inorganic mineral and the release agent, deterioration in the fixability is prevented and the generation of spenting is suppressed.

SUMMARY OF THE INVENTION

Japanese Patent No. 6,020,458 discloses a method that, through the use of a softening agent that exhibits an excellent plasticizing performance, brings about a reduction in toner viscosity during fixing.

However, a highly plasticizing softening agent readily transfers to the toner surface and outmigration of the plasticizer to the toner surface then occurs during storage, and, for example, a reduction in image density is produced due to a decline in flowability.

Japanese Patent No. 5,196,120, on the other hand, discloses a method that brings about a uniform microdispersion of a wax that exhibits releasability. This serves to promote exudation of the wax to the toner surface during fixing and to provide releasability during fixing.

However, because this wax has an inadequate plasticizing action, the toner-softening effect is low and it is necessary to lower the Tg of the binder resin to achieve low-temperature fixing. The heat resistance during storage is reduced as a result.

In addition, the plasticizer or release agent used in both of these methods exhibits crystallinity, and these generally undergo crystal growth into a plate or acicular shape. When these are present in toner, stress—due, for example, to stress during image formation—concentrates at their interface with the binder resin and cracks are readily produced therefrom and a reduction in toner flowability occurs.

In order to solve the preceding, the development has been desired of an art that, through the use of a plasticizer that is highly compatible with the binder resin, brings about a satisfactory softening of the binder resin during fixing even when the Tg is not lowered and that also does not cause exposure of the plasticizer at the toner surface during toner storage.

Thus, the present invention provides a toner for which, even when a wax exhibiting an excellent binder resin plasticization action is used, the low-temperature fixability coexists in balance with the heat-resistant storability and timewise stability, and the durability during continuous paper feed is also excellent. The present invention additionally provides a method for producing this toner.

The present invention relates to a toner having: a toner particle that contains a binder resin and a wax, wherein:

the binder resin contains a styrene-acrylic copolymer;

the content of the styrene-acrylic copolymer in the binder resin is at least 50 mass %;

the wax contains a wax A;

at least 15.0 mass parts of the wax A compatibilizes at 100° C. with 100 mass parts of a styrene-butyl acrylate copolymer, which is a copolymer of 75 mass parts of styrene monomer and 25 mass parts of butyl acrylate monomer and has a weight-average molecular weight of 30,000; and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 μm, and the ratio of r1 to r2 is from 1.0 to 3.0

The present invention further relates to a toner comprising: a toner particle that contains a binder resin and a wax, wherein:

the binder resin contains a styrene-acrylic copolymer;

the content of the styrene-acrylic copolymer in the binder resin is at least 50 mass %;

the wax contains an ester wax of a diol having from 2 to 6 carbons and an aliphatic monocarboxylic acid having from 14 to 22 carbons;

the ester wax has a solubility parameter of at least 8.83 $(cal/cm^3)^{1/2}$; and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 μm, and the ratio of r1 to r2 is from 1.0 to 3.0.

The present invention further relates to a method for producing a toner comprising: a toner particle that contains a wax and a binder resin containing a styrene-acrylic copolymer, wherein:

the steps of producing the toner particle include either step (i) or step (ii) below;

(i) a step of forming, in an aqueous medium, particles of a polymerizable monomer composition containing the wax and a polymerizable monomer that can produce the binder resin containing a styrene-acrylic copolymer, and polymerizing the polymerizable monomer present in the particles of the polymerizable monomer composition, and (ii) a step of forming, in an aqueous medium, particles of a resin solution obtained by dissolving or dispersing the wax and the binder resin containing a styrene-acrylic copolymer in an organic solvent, and removing the organic solvent present in the particles of the resin solution, the content of the styrene-acrylic copolymer in the binder resin is at least 50 mass %;

the wax contains a wax A;

at least 15.0 mass parts of the wax A compatibilizes at 100° C. with 100 mass parts of a styrene-butyl acrylate copolymer, which is a copolymer of 75 mass parts of styrene monomer and 25 mass parts of butyl acrylate monomer and has a weight-average molecular weight of 30,000; and in a cross section of the toner particle observed using a scanning transmission electron microscope, domains of the wax are present, the average number of the domains is from 20 to 2,000, and using r1for the average major diameter of the domains and r2 for the average minor diameter of the domains, is from 0.03 μm to 1.00 and the ratio of r1 to r2 is from 1.0 to 3.0.

The present invention can thus provide a toner for which, even when a wax exhibiting an excellent binder resin plasticization action is used, the low-temperature fixability coexists in balance with the heat-resistant storability and timewise stability, and the durability during continuous paper feed is also excellent. The present invention can additionally provide a method for producing this toner.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

The toner according to the present invention has a toner particle that contains a binder resin and a wax, wherein the binder resin contains a styrene-acrylic copolymer, the content of the styrene-acrylic copolymer in the binder resin is at least 50 mass %, the wax contains a wax A, at least 15.0 mass parts of the wax A compatibilizes at 100° C. with 100 mass parts of a styrene-butyl acrylate copolymer, which is a copolymer of 75 mass parts of styrene monomer and 25 mass parts of butyl acrylate monomer and has a weight-average molecular weight of 30,000, and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00μm, and the ratio of r1 to r2 is from 1.0 to 3.0.

This toner contains a wax A that exhibits high compatibility with the binder resin that contains a styrene-acrylic copolymer.

Thus, at least 15.0 mass parts of the wax A compatibilizes at 100° C. with 100 mass parts of a styrene-butyl acrylate polymer, said styrene-butyl acrylate polymer being a copolymer of 75 mass parts of styrene monomer and 25 mass parts of butyl acrylate monomer and having a weight-average molecular weight of 30,000.

To determine the compatibilization amount under consideration, 1.00 g of the indicated styrene-butyl acrylate copolymer is measured into a 30-mL vial; heating to 100° C. is carried out; the wax A is then added to the vial; and thorough mixing is performed at 100° C. and visual observation is undertaken.

With regard to the presence/absence of compatibility, the determination is made that compatibilization has occurred when transparency is seen by the visual observation.

The maximum amount scored as compatible is determined by adding the wax A in 0.005 g portions (0.5 mass parts per 100 mass parts of the styrene-butyl acrylate copolymer).

The low-temperature fixability is improved by the incorporation in the toner particle of a wax A having the indicated property.

In addition, with regard to the compatibility under consideration, preferably at least 25.0 mass parts and more preferably at least 40.0 mass parts of the wax A compatibilizes at 100° C. with 100 mass parts of the styrene-butyl acrylate copolymer. On the other hand, while not intended as a particular limitation, the upper limit on this compatibility is preferably not more than about 100.0 mass parts.

This compatibilization amount can be controlled through the solubility parameter (SP value) and molecular weight of the wax A.

Using SPw and SPc, respectively, for the solubility parameters of the wax A and the styrene-butyl acrylate copolymer and using Mw for the weight-average molecular weight of the wax A, the SPw, SPc, and Mw preferably satisfy the following formula (1) and more preferably satisfy the following formula (1)'. The unit for the solubility parameters here is $(cal/cm^3)^{1/2}$.

$$(SPc-SPw)^2 \times Mw \leq 680 \quad (1)$$

$$(SPc-SPw)^2 \times Mw \leq 600 \quad (1)'$$

A satisfactory compatibility by the wax with the binder resin can be provided by using a wax A that satisfies the relationship in formula (1).

In a cross section of the toner particle observed using a scanning transmission electron microscope, domains of the wax are present and the average number of the domains is from 20 to 2,000.

When the average number of the domains is at least 20, a satisfactory speed is then obtained for plasticization by the wax A-containing wax of the binder resin during fixing and the toner will exhibit an excellent low-temperature fixability.

On the other hand, having the average number of the domains be not more than 2,000 provides an inhibition of the reduction in the heat-resistant storability that is caused by an increase in the wax A-containing wax in a compatibilized state due to an excessive microdispersion.

The average number of the domains is preferably from 50 to 1,600 and is more preferably from 100 to 1,000.

r1 is from 0.03 μm to 1.00 μm where r1 is the average major diameter of the domains and r2 is their average minor diameter.

The reduction in the heat-resistant storability caused by an excessive reduction in the domain diameter is suppressed when the average major diameter (r1) of the domains is at least 0.03 μm.

When, on the other hand, the average major diameter (r1) of the domains is not more than 1.00 μm, this secures to a certain degree the presence of distance between the domains and the toner particle surface and suppresses exposure of the wax A-containing wax at the toner particle surface. As a result, the heat-resistant storability of the toner is improved, and in addition excessive exudation of the wax A during long print runs is suppressed and the transfer efficiency during long print runs is improved.

The average major diameter (r1) of the domains is preferably from 0.05 μm to 0.95 μm and is more preferably from 0.10 μm to 0.80 μm.

The ratio of r1 to r2 (r1/r2) is from 1.0 to 3.0.

When the value of this (r1/r2) is not more than 3.0, the domains then do not assume a plate shape and an inhibition can be obtained of the exposure of the wax at the toner particle surface due to crystal growth caused by the orientation to the domains, with elapsed time, of the compatibilized portion of the wax present in the binder resin. As a result, reductions in image density caused by a loss of flowability are suppressed even when standing under severe conditions occurs. In addition, excessive exudation of the wax A during long print runs is suppressed and the transfer efficiency during long print runs is enhanced.

The value of this (r1/r2) is preferably from 1.0 to 2.8 and more preferably from 1.0 to 2.6.

By using this wax A, which exhibits a high compatibility with binder resin that contains a styrene-acrylic copolymer, and controlling the state of occurrence of the wax domains in the toner particle, the low-temperature fixability can be made to coexist in balance with the heat-resistant storability and timewise stability and a toner can be provided that exhibits an excellent durability during continuous paper feed.

The method for producing the toner is not particularly limited; however, control of the state of occurrence of the wax domains in the toner particle is readily exercised when the toner particle production steps include either the following step (i) or step (ii).

(i) A step of forming, in an aqueous medium, particles of a polymerizable monomer composition containing the wax and a polymerizable monomer that can produce the binder resin that contains a styrene-acrylic copolymer, and polymerizing the polymerizable monomer present in the particles of the polymerizable monomer composition (suspension polymerization method).

(ii) A step of forming, in an aqueous medium, particles of a resin solution obtained by dissolving or dispersing the wax and the binder resin that contains a styrene-acrylic copolymer in an organic solvent, and removing the organic solvent present in the particles of the resin solution (dissolution suspension method).

A detailed description follows for the suspension polymerization method of (i), but this should not be taken to mean that the present invention is limited to or by this.

Step of Preparing Polymerizable Monomer Composition

A polymerizable monomer composition is prepared by combining and mixing the following: polymerizable monomer that can produce the binder resin that contains a styrene-acrylic copolymer, a wax containing the wax A, and as necessary other components such as a colorant, polar resin, charge control agent, and so forth.

The colorant may be preliminarily dispersed in the polymerizable monomer or organic solvent using, for example, a stirred media mill, and then combined and mixed with another composition, or the colorant may be dispersed after the entire composition has been mixed up.

Granulation Step into Particles of Polymerizable Monomer Composition

The particles of the polymerizable monomer composition are formed in the aqueous medium as follows: an aqueous medium containing a dispersion stabilizer is prepared and is introduced into, for example, a stirred vessel provided with a stirrer that can generate a high shear force, and the polymerizable monomer composition is added thereinto and is dispersed by stirring.

A known surfactant, organic dispersing agent, or inorganic dispersing agent can be used for the dispersion stabilizer here.

Among the preceding, inorganic dispersing agents are resistant to disruptions in the stability even by the polymerization temperature and the passage of time, can also be easily washed out, and tend not to exercise effects on the toner and thus can be advantageously used.

These inorganic dispersing agents can be exemplified by the following:

multivalent metal salts of phosphoric acid, e.g., tricalcium phosphate, magnesium phosphate, aluminum phosphate, and zinc phosphate; carbonates, e.g., calcium carbonate and magnesium carbonate; inorganic salts, e.g., calcium metasilicate, calcium sulfate, and barium sulfate; calcium hydroxide, magnesium hydroxide, and aluminum hydroxide; and inorganic oxides such as silica, bentonite, and alumina.

These inorganic dispersing agents can be almost completely eliminated by dissolution through the addition of acid or alkali after the completion of polymerization.

Polymerization Step

The polymerizable monomer present in the resulting particles of the polymerizable monomer composition is polymerized to obtain a resin particle dispersion. The binder resin is produced by the polymerization of the polymerizable monomer. Common stirred vessels capable of temperature control/adjustment can be used in this polymerization step.

The polymerization temperature is preferably at least 40° C. and is more preferably from 50° C. to 90° C. The polymerization temperature may be constant from start to finish, or may be increased in the second half of the polymerization step for the purpose of obtaining a desired molecular weight distribution. The stirring impeller used for stirring may be any stirring impeller that induces the suspension of the resin particle dispersion without stagnation and that can maintain a uniform temperature within the vessel.

Volatile Component Removal Step

A volatile component removal step may be performed in order to remove, for example, unreacted polymerizable monomer, from the resin particle dispersion after completion of the polymerization step. This volatile component removal step is carried out by heating and stirring the resin particle dispersion in a stirred vessel provided with a stirring means. The heating conditions during the volatile component removal step are adjusted as appropriate considering the vapor pressure of the component to be removed, e.g., the polymerizable monomer. The volatile component removal step may be carried out at normal pressure or under reduced pressure.

Cooling Step

After completion of the volatile component removal step, the resin particle dispersion may be submitted to a cooling step in order to lower the liquid temperature prior to transfer to the ensuing steps. The state of occurrence of the wax can be altered depending on the conditions in the cooling step.

The cooling conditions can be determined as a function of the cooling start temperature, the cooling rate, and the cooling completion temperature.

The cooling start temperature is preferably a temperature higher than the crystallization temperature of the wax in the binder resin. When the cooling start temperature is in the indicated range, microfine crystal nuclei of the wax are produced by cooling and domains of the wax then grow using these as nuclei, and the production of microfine domains is promoted as a result.

The cooling rate is preferably at least 0.33° C./second and is more preferably at least 1.00° C./second.

When the cooling temperature is in the indicated range, the binder resin undergoes a satisfactorily rapid hardening accompanying the cooling and as a consequence oriented growth of the crystals is inhibited—even for substances that readily produce plate-shaped crystals such as the wax A—and near-spherical domains can then be formed.

The cooling completion temperature is preferably at or below the glass transition temperature (Tg) of the binder resin. Wax domain growth can be suppressed due to hardening of the binder resin when the cooling completion temperature is in the indicated range.

The state of occurrence of the wax domains can be checked by observation of the toner particle cross section using a scanning transmission electron microscope.

Solid-liquid Separation Step, Washing Step, and Drying Step

The toner particle dispersion may be treated with acid or alkali with the goal of removing the dispersion stabilizer attached to the toner particle surface. After removal of the dispersion stabilizer from the toner particle, the toner particle is separated from the aqueous medium by a common solid-liquid separation method; however, in order to completely eliminate the acid or alkali and dispersion stabilizer dissolved therein, preferably water is added again and the toner particle is washed. This washing step can be repeated several times, and, after a thorough washing has been carried out, solid-liquid separation is carried out again to obtain the toner particle. As necessary, the resulting toner particle may be dried using a known drying means.

The weight-average particle diameter of the resulting toner particle is preferably from 3 μm to 10 μm and is more preferably from 4 μm to 8 μm. The weight-average particle diameter of the toner particle can be controlled through the amount of addition of the dispersion stabilizer used in the granulation step.

External Addition Step

The addition of an external additive to the resulting toner particle may be carried out with the goal of enhancing, for example, the flowability, charging performance, and caking resistance. The external addition step is carried out by introducing the external additive and toner particle into a mixing apparatus equipped with an impeller that rotates at high speed and performing thorough mixing.

When, on the other hand, the toner particle is obtained by the dissolution suspension method, a resin solution is prepared by dispersing or dissolving the following to uniformity in an organic solvent: binder resin containing styrene-acrylic copolymer, wax containing the wax A, and optional other components e.g., polar resin, colorant, charge control agent, and so forth.

Particles of the resin solution are formed by dispersing the resulting resin solution in an aqueous medium, and the organic solvent present in the resulting particles is then removed to obtain a toner particle having a desired particle diameter.

The obtained toner particle can be submitted to a cooling step, washing step, drying step, and external addition step using the same procedures as in the suspension polymerization described in the preceding.

There are no particular limitations on the organic solvent used for the resin solution in the dissolution suspension method insofar as the organic solvent is compatible with the starting materials for the toner particle, e.g., the binder resin, wax, and so forth; however, viewed from the perspective of solvent removal, an organic solvent is preferred that exhibits a certain vapor pressure even below the boiling point of water. Examples are toluene, xylene, ethyl acetate, butyl acetate, methyl ethyl ketone, methyl isobutyl ketone, and so forth.

The binder resin contains a styrene-acrylic copolymer.

This styrene-acrylic copolymer is a copolymer of a styrenic monomer and an acrylic monomer (acrylic acid, methacrylic acid, and their alkyl esters).

This styrene-acrylic copolymer may be present in the binder resin in a state in which this copolymer is constituted of only styrene-acrylic copolymer or may be present in the binder resin in the state of a block copolymer or graft copolymer with, for example, another polymer, or a mixture thereof.

The content of the styrene-acrylic copolymer in the binder resin is at least 50 mass % and is preferably from 80 mass % to 100 mass %.

The developing characteristics and durability of the toner are enhanced by the presence of the styrene-acrylic copolymer in the binder resin.

In addition to the styrene-acrylic copolymer, a resin or polymer known for use in toners can be used in the binder resin.

The following are examples of the styrenic monomer:

styrene, α-methylstyrene, β-methylstyrene, o-methylstyrene, m-methylstyrene, p-methylstyrene, 2,4-dimethylstyrene, and divinylbenzene.

A single species of styrenic monomer can be used or a combination of two or more species selected from styrenic monomers can be used.

The following are examples of the acrylic monomer:

alkyl acrylate esters such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, n-decyl acrylate, and n-dodecyl acrylate;

alkyl methacrylate esters such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, n-decyl methacrylate, and n-dodecyl methacrylate;

acrylate diesters such as diethylene glycol diacrylate, triethylene glycol diacrylate, tetraethylene glycol diacrylate, polyethylene glycol diacrylate, and 1,6-hexanediol diacrylate; and acrylic acid and methacrylic acid.

A single species of acrylic monomer can be used or a combination of two or more species selected from acrylic monomers can be used.

In a preferred embodiment, the styrene-acrylic copolymer contains at least one copolymer selected from the group consisting of styrene-alkyl acrylate ester copolymers and styrene-alkyl methacrylate ester copolymers, wherein the number of carbons in the alkyl group in the alkyl acrylate ester and the number of carbons in the alkyl group in the alkyl methacrylate ester are from 2 to 10 and more preferably from 2 to 8.

When the number of carbons in the alkyl group is in the indicated range, the compatibility between the wax A and the resulting styrene-acrylic copolymer is kept at a high level. In addition, the glass transition temperature (Tg) of the styrene-acrylic copolymer-containing binder resin can be brought into a favorable range.

The glass transition temperature (Tg) of the binder resin can be brought into a desired range by adjusting the polymerization ratio between the styrenic monomer and the acrylic monomer.

In specific terms, the polymerization ratio between the styrenic monomer and acrylic monomer (styrenic monomer: acrylic monomer), expressed on a mass basis, is preferably 65:35 to 100:0 and is more preferably 70:30 to 85:15.

The glass transition temperature (Tg) of the binder resin is preferably from 25° C. to 65° C.

Various polymerization initiators, e.g., peroxide-type polymerization initiators, azo-type polymerization initiators, and so forth, can be used as the polymerization initiator that is used during toner particle production.

Organic peroxide-type polymerization initiators can be exemplified by peroxy esters, peroxydicarbonates, dialkyl peroxides, peroxyketals, ketone peroxides, hydroperoxides, and diacyl peroxides.

Persulfates and hydrogen peroxide are examples of inorganic peroxide-type polymerization initiators.

Specific examples of the peroxide-type polymerization initiators are as follows: peroxy esters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, and t-butyl peroxy-2-ethylhexyl monocarbonate;

diacyl peroxides such as benzoyl peroxide; peroxydicarbonates such as diisopropyl peroxydicarbonate; peroxyketals such as 1,1-di-t-hexyl peroxycyclohexane; dialkyl peroxides such as di-t-butyl peroxide; and also t-butyl peroxyallyl monocarbonate.

The azo-type polymerization initiators are exemplified by 2,2'-azobis(2,4-dimethylvaleronitrile), 2,2'-azobisisobutyronitrile, 1,1'-azobis(cyclohexane-l-carbonitrile), 2,2'-azobis-4-methoxy-2,4-dimethylvaleronitrile, azobisisobutyronitrile, and dimethyl 2,2'-azo(2-methylpropionate).

As necessary, two or more of these polymerization initiators may also be used at the same time.

The polymerization initiator is preferably used in an amount from 0.10 mass parts to 20.0 mass parts per 100.0 mass parts of the polymerizable monomer.

The toner particle may also contain a polar resin.

The polar resin can be exemplified by polyester resins.

Through the use of a polyester resin as the polar resin, the lubricity inherently possessed by this resin can be expected when this resin segregates to the toner particle surface to form a shell.

The condensation polymer of an alcohol monomer and a carboxylic acid monomer is an example of a polyester resin.

The alcohol monomer can be exemplified by the following:

alkylene oxide adducts on bisphenol A, e.g., polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomer, on the other hand, can be exemplified by the following:

aromatic dicarboxylic acids such as phthalic acid, isophthalic acid, and terephthalic acid and their anhydrides; alkyl dicarboxylic acids such as succinic acid, adipic acid, sebacic acid, and azelaic acid and their anhydrides; succinic acid substituted by an alkyl group or alkenyl group having 6 to 18 carbons, and anhydrides thereof; and unsaturated dicarboxylic acids such as fumaric acid, maleic acid, and citraconic acid and their anhydrides.

The following monomers can be used in addition to the preceding:

polyhydric alcohols such as sorbitol, sorbitan, and the oxyalkylene ethers of novolac-type phenolic resins; and polybasic carboxylic acids such as trimellitic acid, pyromellitic acid, benzophenonetetracarboxylic acid, and their anhydrides.

Among the preceding, a condensation polymer of an at least dibasic carboxylic acid and a bisphenol derivative as represented by formula (I) below is preferred for its excellent charging characteristics.

The at least dibasic carboxylic acid is exemplified by fumaric acid, maleic acid, phthalic acid, terephthalic acid, trimellitic acid, and pyromellitic acid and their anhydrides and lower alkyl esters.

(I)

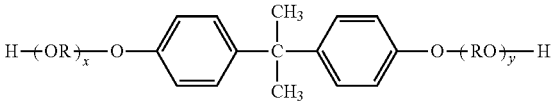

(In the formula, R represents the ethylene group or propylene group, x and y are each integers equal to or greater than 1, and the average value of x+y is 2 to 10.)

The content of the polar resin, expressed per 100.0 mass parts of the binder resin or polymerizable monomer that produces the binder resin, is preferably from 1.0 mass parts to 20.0 mass parts and is more preferably from 2.0 mass parts to 10.0 mass parts.

The toner particle may contain a colorant. This colorant can be exemplified by various heretofore known dyes and pigments.

Black colorants can be exemplified by carbon black, magnetic bodies, and black colorants provided by color mixing the yellow, magenta, and cyan colorants given in the following to produce a black color.

The yellow colorants can be exemplified by monoazo compounds, disazo compounds, condensed azo compounds, isoindolinone compounds, anthraquinone compounds, azo-metal complexes, methine compounds, and allylamide compounds.

Specific examples are C. I. Pigment Yellow 74, 93, 95, 109, 111, 128, 155, 174, 180, and 185.

The magenta colorants can be exemplified by monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269, and C. I. Pigment Violet 19.

The cyan colorants can be exemplified by copper phthalocyanine compounds and derivatives thereof, anthraquinone compounds, and basic dye lake compounds.

Specific examples are C. I. Pigment Blue 1, 7, 15, 15:1, 15:2, 15:3, 15:4, 60, 62, and 66.

The toner can be used in the form of a magnetic toner. In this case the toner particle should contain a magnetic body. The magnetic body may also function as a colorant in this case.

The magnetic body can be exemplified by iron oxides such as magnetite, hematite, and ferrite; metals such as iron, cobalt, and nickel; and alloys of these metals with a metal such as aluminum, cobalt, copper, lead, magnesium, tin, zinc, antimony, beryllium, bismuth, cadmium, calcium, manganese, selenium, titanium, tungsten, or vanadium, and their mixtures.

The colorant should be selected considering the hue angle, chroma, lightness, lightfastness, OHP transparency, and dispersibility in the toner particle. A single one of these colorants may be used or a mixture may be used, and these colorants may also be used in a solid solution state.

The colorant content, considered per 100.0 mass parts of the binder resin or polymerizable monomer that produces the binder resin, is preferably from 1.0 mass parts to 20.0 mass parts.

At least 15.0 mass parts of the wax A compatibilizes at 100° C. with 100 mass parts of the styrene-butyl acrylate copolymer, which is a copolymer of 75 mass parts of styrene monomer and 25 mass parts of butyl acrylate monomer and has a weight-average molecular weight of 30,000.

With regard to the presence/absence of compatibility, the determination is made that compatibilization has occurred when transparency is seen by visual observation.

Known waxes may be used without particular limitation as long as the particular wax satisfies the condition indicated above.

Viewed from the standpoint of compatibility with the styrene-acrylic copolymer present in the binder resin, ester waxes that are a condensate of an alcohol component with a carboxylic acid component are a preferred example of the wax A.

In specific terms, the wax A preferably contains an ester wax of a diol and an aliphatic monocarboxylic acid.

This ester wax is preferably an ester wax of a diol having from 2 to 6 carbons and an aliphatic monocarboxylic acid having from 14 to 22 carbons.

In addition, the solubility parameter (SP value) of the ester wax is preferably at least 8.83 $(cal/cm^3)^{1/2}$ and is more preferably at least 8.85 $(cal/cm^3)^{1/2}$. The upper limit for this SP value is not particularly limited, but not more than 8.90 $(cal/cm^3)^{1/2}$ is preferred.

The diol having from 2 to 6 carbons can be exemplified by ethylene glycol, diethylene glycol, 1,3-propanediol, 1,4-butanediol, and 1,6-hexanediol.

The aliphatic monocarboxylic acid having from 14 to 22 carbons can be exemplified by aliphatic monocarboxylic acids such as myristic acid, palmitic acid, stearic acid, and behenic acid.

The content of the wax A, per 100 mass parts of the binder resin, is preferably from 1 mass parts to 30 mass parts and is more preferably from 5 mass parts to 25 mass parts.

The wax may additionally contain a hydrocarbon wax.

This hydrocarbon wax exhibits a strong phase-separation behavior versus styrene-acrylic copolymers and as a consequence separates more rapidly than the wax A during the cooling step, supra, thereby forming microfine crystal nuclei.

Because wax A domains form around these crystal nuclei, a larger number of microfine domains can then be formed.

The hydrocarbon wax can be exemplified by aliphatic hydrocarbon waxes such as low molecular weight polyethylenes, low molecular weight polypropylenes, microcrystalline waxes, paraffin waxes, and Fischer-Tropsch waxes; oxides of aliphatic hydrocarbon waxes such as oxidized polyethylene waxes, and their block copolymers; and waxes provided by the grafting of an aliphatic hydrocarbon wax with a vinyl monomer such as styrene or acrylic acid.

The content of the hydrocarbon wax is preferably from 0.5 to 5.0 mass parts per 100 mass parts of the binder resin.

When the hydrocarbon wax content is in the indicated range, a satisfactory effect with regard to crystal nuclei formation is obtained, and a satisfactory adherence between the paper and the fixed toner image is also obtained and the low-temperature fixability is further enhanced as a consequence.

The mixing mass ratio between the wax A and the hydrocarbon wax (wax A:hydrocarbon wax) is preferably 30:1 to 1:1 and is more preferably 25:1 to 2:1.

The melting points of the wax A and the hydrocarbon wax are preferably from 30° C. to 130° C. and are more preferably from 60° C. to 100° C. By satisfying this thermal property, low-temperature fixability and heat-resistant storability are both readily secured for the resulting toner.

The toner particle may contain a charge control agent. This charge control agent can be exemplified by the following:

organometal compounds, chelate compounds, monoazometal compounds, acetylacetone-metal compounds, urea derivatives, metal-containing salicylic acid compounds, metal-containing naphthoic acid compounds, quaternary ammonium salts, calixarene, silicon compounds, non-metal carboxylic acid compounds and their derivatives, and sulfonic acid resins containing the sulfonic acid group, sulfonate salt group, or sulfonate ester group.

Specific examples of negative-charging charge control agents are as follows:

metal compounds of aromatic carboxylic acids as represented by salicylic acid, alkylsalicylic acids, dialkylsalicylic acids, naphthoic acid, and dicarboxylic acid; polymers and copolymers that have a sulfonic acid group, sulfonate salt group, or sulfonate ester group; metal salts and metal complexes of azo dyes and azo pigments; boron compounds; silicon compounds; and calixarene.

Positive-charging charge control agents, on the other hand, are exemplified by the following:

quaternary ammonium salts and polymeric compounds that have a quaternary ammonium salt in side chain position; guanidine compounds; nigrosine compounds; and imidazole compounds.

Among the preceding, negative-charging charge control agents are frequently used.

Polymers and copolymers that have a sulfonic acid group, sulfonate salt group, or sulfonate ester group can be exemplified by homopolymers of a sulfonic acid group-containing vinylic monomer as represented by styrenesulfonic acid, 2-acrylamido-2-methylpropanesulfonic acid, 2-methacrylamido-2-methylpropanesulfonic acid, vinylsulfonic acid, and methacrylsulfonic acid, and by copolymers of these sulfonic acid group-containing vinylic monomers with other vinylic monomer.

The content of the charge control agent, expressed per 100.0 mass parts of the binder resin or polymerizable monomer that produces the binder resin, is preferably from 0.01 mass parts to 20.0 mass parts and is more preferably from 0.1 mass parts to 10.0 mass parts.

An external additive is preferably added to the toner particle from the standpoint of enhancing the image quality for the toner.

This external additive can be exemplified by inorganic fine particles such as silica fine particles, titanium oxide fine particles, strontium titanate fine particles, and aluminum oxide fine particles.

The inorganic fine particles are preferably subjected to a hydrophobic treatment with a hydrophobic agent such as a silane coupling agent, a silicone oil, or a mixture of these.

The content of the external additive, per 100.0 mass parts of the toner particle, is preferably from 0.1 mass parts to 5.0 mass parts and is more preferably from 0.1 mass parts to 3.0 mass parts.

The methods for calculating and the methods for measuring the various property values specified for the present invention are described in the following. Method for Calculating Solubility Parameter (SP Value)

The solubility parameter (SP value) is determined using equation (2) according to Fedors.

For the values of Δei and Δvi, reference is made to "Energies of Vaporization and Molar Volumes (25° C.) of Atoms and Atomic Groups" in Tables 3-9 of "Basic Coating Science" (pp. 54-57, 1986 (Maki Shoten Publishing)).

The unit for the SP value is $(cal/cm^3)^{1/2}$, but conversion to the $(J/m^3)^{1/2}$ unit can be carried out using 1 $(cal/cm^3)^{1/2}=2.046\times10^3\ (J/m^3)^{1/2}$.

$$\delta i=(Ev/V)^{1/2}=(\Delta ei/\Delta vi)^{1/2} \quad (2)$$

Ev: Energy of vaporization

V: Molar volume

Δei: Energy of vaporization of the atoms or atomic groups of component i

Δvi: Molar volume of the atoms or atomic groups of component i

Method for Measuring Weight-Average Molecular Weight (Mw) of Wax A

The weight-average molecular weight (Mw) of the wax A is measured using gel permeation chromatography (GPC) as follows.

First, wax A is dissolved in tetrahydrofuran (THF) at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

Instrument: "HLC-8220GPC" high-performance GPC instrument [Tosoh Corporation]

Column: 2×LF-604 [Showa Denko Kabushiki Kaisha]

Eluent: THF

Flow rate: 0.6 mL/min

Oven temperature: 40° C.

Sample injection amount: 0.020 mL

A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring Weight-Average Particle Diameter (D4)

The weight-average particle diameter (D4) of the toner particle is measured as follows.

The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μμA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 to 60 μm.

The specific measurement procedure is as follows.

(1) 200 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) 30 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, formed from a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180° . 3.3 L of deionized water is introduced into the water tank of the ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner particle-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the dedicated software provided with the instrument and the weight-average particle diameter (D4) is calculated. When set to graph/volume% with the dedicated software, the "average diameter" on the "analysis/volumetric statistical value (arithmetic average)" screen is the weight-average particle diameter (D4).

Observation of Toner Particle Cross Section Using Scanning Transmission Electron Microscope The state of occurrence of the wax in the toner particle is checked by observation of the toner particle cross section using a scanning transmission electron microscope.

The wax in domain form is observed in the toner particle cross-sectional image using a scanning transmission electron microscope. The state of occurrence of the wax is identified by measuring the number and shape of the wax domains.

The procedure used to observe the toner particle cross section is as follows.

The toner particle was embedded using a visible light-curing embedding resin (D-800, Nisshin EM Co., Ltd.) followed by sectioning in a thickness of 70 nm using an ultrasound ultramicrotome (UC7, Leica).

Of the resulting thin-section samples, 10 are randomly selected from thin-section samples in which the diameter of the toner particle cross section is within the weight-average particle diameter (D4) of the toner particle ±2.0 μm.

The selected thin-section samples are stained for 15 minutes in a 500 Pa $RuO_4$ gas atmosphere using a vacuum stainer (VSC4R1H, Filgen, Inc.), and the STEM image is then produced using the scanning imaging mode on a scanning transmission electron microscope (JEM2800, JEOL Ltd.).

The image was acquired using a STEM probe size of 1 nm and an image size of 1024×1024 pixels. The STEM image is acquired by adjusting the Contrast to 1425 and the Brightness to 3750 on the Detector Control panel for the bright-field image and adjusting the Contrast to 0.0, the Brightness to 0.5, and the Gamma to 1.00 on the Image Control panel.

The resulting STEM image is binarized (threshold 120/255 gradations) using "Image-Pro Plus" (Media Cybernetics, Inc.) image processing software to emphasize the distinction between the wax domains and the binder resin regions.

The regions seen as white are wax domains when 210 is used for the binarization threshold.

Method for Calculating Average Number, Average Major Diameter, and Average Minor Diameter of Wax Domains The number of wax domains is counted in each of the 10 selected STEM images of the toner particle cross section, and the average value thereof is used as the average number of domains.

In addition, in each of the 10 selected STEM images of the toner particle cross section, a 2 μm×2 μm region is randomly selected and the largest diameter is measured for all of the domains therein, and the average value thereof is taken to be the average major diameter (r1) of the domains. The smallest diameter of all the domains is similarly measured and the average value thereof is taken to be the average minor diameter (r2) of the domains.

EXAMPLES

The present invention is specifically described using the examples provided below, but the present invention is not limited to or by these examples. The number of parts used in the examples indicates mass parts in all instances.

Toner Particle 1 Production Example

| | |
|---|---|
| Styrene | 75.0 parts |
| n-Butyl acrylate | 25.0 parts |
| 1,6-Hexanediol diacrylate | 0.6 parts |
| Copper phthalocyanine pigment (Pigment Blue 15:3) | 6.0 parts |
| Aluminum salicylate compound (Bontron E-88, Orient Chemical Industries Co., Ltd.) | 0.7 parts |
| Polar resin (saturated polyester resin provided by the condensation polymerization reaction of terephthalic acid and isophthalic acid with the 2 mol adduct of propylene oxide on bisphenol A, weight-average molecular weight = 13,000, acid value = 8 mg KOH/g, glass transition temperature = 74° C.) | 4.0 parts |
| Wax 1 (ethylene glycol distearate, melting point = 76° C.) | 15.0 parts |
| Wax 2 (Fischer-Tropsch wax, melting point = 77° C.) | 1.0 parts |

The preceding materials were mixed; 15-mm ceramic beads were introduced into the resulting mixture; and dispersion was performed for 2 hours using a wet attritor (Nippon Coke & Engineering Co., Ltd.) to obtain a polymerizable monomer composition 1.

Otherwise, 6.3 parts of sodium phosphate ($Na_3PO_4$) was introduced into 414.0 parts of deionized water and heating to 60° C. was carried out while stirring using a CLEARMIX (M Technique Co., Ltd.).

This was followed by the introduction of an aqueous calcium chloride solution of 3.6 parts of calcium chloride ($CaC_{12}$) dissolved in 25.5 parts of deionized water; stirring was continued to prepare an aqueous medium containing a dispersion stabilizer composed of tricalcium phosphate ($Ca_3(PO_4)_2$).

9.0 parts of the polymerization initiator t-butyl peroxypivalate was added to the polymerizable monomer composition 1; this was introduced into the aqueous medium described above; and a granulation step was run for 10 minutes while maintaining 15,000 rpm with the CLEARMIX.

Polymerization was then run for 5 hours while holding at 70° C. and stirring in a stirred tank equipped with a common stirrer, followed by heating to 85° C., holding for 1 hour, then heating to 100° C., and holding for 2 hours.

Cooling was subsequently carried out to 40° C. at a rate of 1.00° C./second to obtain a toner particle dispersion 1.

Hydrochloric acid was added to toner particle dispersion 1 to bring the pH to 1.4 or below and dissolve the dispersion stabilizer; filtration, washing, and drying were then carried out to obtain a toner particle 1.

Toner Particles 2 to 19 and 21 Production Example

Toner particles 2 to 19 and 21 were obtained proceeding as in the Toner Particle 1 Production Example, but with the materials used and cooling conditions changed as indicated in Table 1.

TABLE 1

| Toner particle No. | styrene (parts) | Acrylic monomer type | Acrylic monomer parts | Wax 1 type | Wax 1 (X) | Wax 1 SP value | Wax 1 parts | Wax 2 type | Wax 2 parts | Cooling rate (° C./sec) |
|---|---|---|---|---|---|---|---|---|---|---|
| 1 | 75.0 | n-Butyl acrylate | 25.0 | Ethylene glycol distearate | 45 | 8.85 | 15.0 | (A) | 10 | 1.00 |
| 2 | 75.0 | n-Butyl acrylate | 25.0 | Ethylene glycol distearate | 45 | 8.85 | 15.0 | — | — | 1.00 |
| 3 | 65.0 | Ethyl acrylate | 35.0 | Ethylene glycol distearate | 45 | 8.85 | 15.0 | (A) | 1.0 | 1.00 |
| 4 | 78.0 | n-Octyl acrylate | 22.0 | Ethylene glycol distearate | 45 | 8.85 | 15.0 | (A) | 1.0 | 1.00 |
| 5 | 45.0 | Methyl acrylate | 55.0 | Ethylene glycol distearate | 45 | 8.85 | 15.0 | (A) | 1.0 | 1.00 |
| 6 | 54.0 | n-Dodecyl acrylate | 46.0 | Ethylene glycol distearate | 45 | 8.85 | 15.0 | (A) | 1.0 | 1.00 |
| 7 | 75.0 | n-Butyl acrylate | 25.0 | Hexanediol distearate | 25 | 8.83 | 15.0 | (A) | 1.0 | 1.00 |
| 8 | 75.0 | n-Butyl acrylate | 25.0 | Diethylene glycol dibehenate | 21 | 8.83 | 15.0 | (A) | 1.0 | 1.00 |
| 9 | 75.0 | n-Butyl acrylate | 25.0 | Ethylene glycol distearate | 45 | 8.85 | 15.0 | (A) | 1.0 | 0.40 |
| 10 | 75.0 | n-Butyl acrylate | 25.0 | Ethylene glycol distearate | 45 | 8.85 | 3.0 | (A) | 1.0 | 2.00 |
| 11 | 75.0 | n-Butyl acrylate | 25.0 | Hexanediol distearate | 25 | 8.83 | 15.0 | (A) | 1.0 | 0.67 |
| 12 | 75.0 | n-Butyl acrylate | 25.0 | Ethylene glycol distearate | 45 | 8.85 | 2.0 | (A) | 1.0 | 1.00 |
| 13 | 75.0 | n-Butyl acrylate | 25.0 | Ethylene glycol distearate | 45 | 8.85 | 25.0 | (A) | 1.0 | 2.00 |
| 14 | 75.0 | n-Butyl acrylate | 25.0 | Ethylene glycol distearate | 45 | 8.85 | 15.0 | (A) | 1.0 | 0.17 |
| 15 | 75.0 | n-Butyl acrylate | 25.0 | Hexanediol distearate | 25 | 8.83 | 25.0 | (A) | 1.0 | 0.33 |
| 16 | 75.0 | n-Butyl acrylate | 25.0 | Ethylene glycol distearate | 45 | 8.85 | 2.0 | (A) | 1.0 | 0.67 |
| 17 | 75.0 | n-Butyl acrylate | 25.0 | Ethylene glycol distearate | 45 | 8.85 | 18.0 | (A) | 1.0 | 2.00 |
| 18 | 75.0 | n-Butyl acrylate | 25.0 | Butanediol dibehenate | 10 | 8.80 | 15.0 | (A) | 1.0 | 1.00 |

TABLE 1-continued

| Toner particle No. | styrene (parts) | Acrylic monomer type | Acrylic monomer parts | Wax 1 type | Wax 1 (X) | Wax 1 SP value | Wax 1 parts | Wax 2 type | Wax 2 parts | Cooling rate (° C./sec) |
|---|---|---|---|---|---|---|---|---|---|---|
| 19 | 75.0 | n-Butyl acrylate | 25.0 | Glycerol tribehenate | 3 | 8.84 | 15.0 | (A) | 1.0 | 1.00 |
| 21 | 75.0 | n-Butyl acrylate | 25.0 | Ethylene glycol dipalmitate | 100 | 8.88 | 15.0 | (A) | 1.0 | 1.00 |

In the table, the (X) indicated under wax 1 represents the "mass parts of wax 1 that compatibilizes at 100° C. with 100 mass parts of the styrene-butyl acrylate copolymer"; the unit for the SP value is $(cal/cm^3)^{1/2}$, and the (A) indicated for wax 2 denotes a Fischer-Tropsch wax (melting point=77° C.).

Toner Particle 20 Production Example

The following materials were introduced under a nitrogen atmosphere into a reactor fitted with a reflux condenser, stirrer, and nitrogen introduction line.

| | |
|---|---|
| Toluene | 100.0 parts |
| Styrene | 75.0 parts |
| n-Butyl acrylate | 25.0 parts |
| 1,6-Hexanediol diacrylate | 0.6 parts |
| t-Butyl peroxypivalate | 3.0 parts |

While stirring the interior of the reactor at 200 rotations per minute, heating at 70° C. and stirring were carried out for 10 hours to obtain a binder resin solution 20.

| | |
|---|---|
| Binder resin solution 20 | 160.0 parts |
| Polar resin (saturated polyester resin provided by the condensation polymerization reaction of terephthalic acid and isophthalic acid with the 2 mol adduct of propylene oxide on bisphenol A, weight-average molecular weight = 13,000, acid value = 8 mg KOH/g, glass transition temperature = 74° C.) | 3.2 parts |
| Wax 1 (ethylene glycol distearate, melting point = 76° C.) | 12.0 parts |
| Wax 2 (Fischer-Tropsch wax, melting point = 77° C.) | 0.8 parts |
| Copper phthalocyanine pigment (Pigment Blue 15:3) | 4.8 parts |
| Aluminum salicylate compound | 0.6 parts |

(Bontron E-88, Orient Chemical Industries Co., Ltd.)

Then, using a wet attritor (Nippon Coke & Engineering Co., Ltd.) filled with ceramic beads having a diameter of 15 mm, these components were mixed and dispersed for 10 hours to obtain a resin composition solution 20.

Otherwise, 6.3 parts of sodium phosphate ($Na_3PO_4$) was introduced into 414.0 parts of deionized water and heating to 60° C. was carried out while stirring using a CLEARMIX (M Technique Co., Ltd.).

This was followed by the introduction of an aqueous calcium chloride solution of 3.6 parts of calcium chloride ($CaCl_2$) dissolved in 25.5 parts of deionized water; stirring was continued to prepare an aqueous medium containing a dispersion stabilizer composed of tricalcium phosphate ($Ca_3(PO_4)_2$).

The resin composition solution 20 was introduced into the aforementioned aqueous medium and a granulation step was run for 10 minutes while maintaining 15,000 rpm with the CLEARMIX to obtain a resin composition dispersion 20.

The toluene in the resin composition dispersion 20 was removed by raising the temperature of the resin composition dispersion 20 to 95° C. and stirring for 120 minutes.

This was followed by cooling to 40° C. at a rate of 1.00° C./second to obtain a toner particle dispersion 20.

Hydrochloric acid was added to toner particle dispersion 20 to bring the pH to 1.4 or below and dissolve the dispersion stabilizer; filtration, washing, and drying were then carried out to obtain a toner particle 20.

Examples 1 to 15 and Comparative Examples 1 to 6

Toners 1 to 13, 20, and 21 (the toners in Examples 1 to 13, 14, and 15) were obtained by adding, to 100.0 parts of the obtained toner particles, 1.0 parts of silica fine particles having a number-average primary particle diameter of 40 nm and mixing using an FM mixer (Nippon Coke & Engineering Co., Ltd.). Toners 14 to 19 (the toners in Comparative Examples 1 to 6) were obtained proceeding in entirely the same manner. The properties of the obtained toners are given in Table 2.

TABLE 2

| | Toner particle No. | Wax domains Average number | Wax domains r1 (μm) | Wax domains r1/r2 | Toner particle D4 (μm) | Toner particle $(SPc - SPw)^2 \times Mw$ |
|---|---|---|---|---|---|---|
| Example 1 | 1 | 314 | 0.25 | 2.0 | 6.2 | 548 |
| Example 2 | 2 | 255 | 0.28 | 2.2 | 6.1 | 548 |
| Example 3 | 3 | 150 | 0.43 | 2.6 | 6.0 | 548 |
| Example 4 | 4 | 606 | 0.18 | 1.9 | 6.3 | 548 |
| Example 5 | 5 | 108 | 0.50 | 2.7 | 6.1 | 548 |
| Example 6 | 6 | 767 | 0.16 | 1.7 | 6.3 | 548 |
| Example 7 | 7 | 101 | 0.44 | 2.7 | 6.2 | 625 |
| Example 8 | 8 | 93 | 0.46 | 2.8 | 6.3 | 721 |
| Example 9 | 9 | 34 | 0.76 | 2.9 | 6.1 | 548 |
| Example 10 | 10 | 1570 | 0.05 | 1.8 | 6.0 | 548 |
| Example 11 | 11 | 24 | 0.91 | 2.2 | 6.2 | 625 |
| Example 12 | 12 | 31 | 0.29 | 2.0 | 5.9 | 548 |
| Example 13 | 13 | 1554 | 0.14 | 1.9 | 6.4 | 548 |
| Example 14 | 20 | 234 | 0.30 | 2.0 | 6.3 | 548 |
| Example 15 | 21 | 521 | 0.19 | 1.7 | 6.1 | 466 |
| Comparative Example 1 | 14 | 20 | 0.98 | 3.4 | 6.3 | 548 |
| Comparative Example 2 | 15 | 37 | 1.11 | 2.8 | 6.4 | 625 |
| Comparative Example 3 | 16 | 15 | 0.47 | 2.5 | 6.1 | 548 |
| Comparative Example 4 | 17 | 2107 | 0.10 | 2.0 | 6.3 | 548 |
| Comparative Example 5 | 18 | 143 | 0.37 | 2.6 | 6.2 | 750 |
| Comparative Example 6 | 19 | 29 | 0.83 | 2.5 | 6.3 | 996 |

In the table, "r1" refers to the average major diameter and "r2" refers to the average minor diameter for the wax domains, while "D4" refers to the weight-average particle diameter for the toner particle.

Performance evaluations were carried out on each of the resulting toners using the following methods.

Evaluation 1: Image Density after Standing under Severe Conditions 200 g of the toner was held for 30 days in a 40° C./95% relative humidity environment and was then used as the evaluation toner.

Image evaluations were performed in a normal-temperature, normal-humidity environment (temperature=23° C., relative humidity=50%) using an LBP-7700C (Canon, Inc.) as the image-forming apparatus. The image density was measured using the tinting strength of the toner as the index.

A solid image was output on A4 color laser copier paper (Canon, Inc., 80 g/m$^2$) with adjustment to provide a toner laid-on level of 0.30 mg/cm$^2$.

The evaluation was performed by measuring the density of the solid image (average value of 5 points: upper right, lower right, center, upper left, and lower left). For the image density, the relative density versus a white background region having an image density of 0.00 was measured using a "504 Spectrodensitometer" (X-Rite, Incorporated).

Evaluation Criteria

A: the image density is at least 1.45

B: the image density is at least 1.35, but less than 1.45

C: the image density is at least 1.20, but less than 1.35

D: the image density is at least 1.05, but less than 1.20

E: the image density is less than 1.05

Evaluation 2: Transfer Efficiency after Long Print Run

The transfer efficiency is an indicator of the transferability and indicates the percentage of the toner developed onto the photosensitive drum that transfers onto the intermediate transfer belt.

This transfer efficiency was measured using the following procedure.

First, the toner was filled into a process cartridge for an "LBP-5050" (Canon, Inc.) full color printer and a solid image was continuously output on a recording medium.

After 3,000 prints of the solid image had been output, the image-forming process was performed up to when the toner had been transferred to the intermediate transfer belt, and the toner transferred onto the intermediate transfer belt and the toner remaining on the photosensitive drum post-transfer were stripped off using transparent polyester pressure-adhesive tape.

Respective density differences were calculated by subtracting the toner density for only the pressure-sensitive adhesive tape applied onto paper, from the toner densities for the application of the stripped-off pressure-sensitive adhesive tapes onto paper.

Using 100 for the sum of the respective toner density differences, the transfer efficiency is the percentage for the toner density difference on the intermediate transfer belt, wherein higher values for this percentage indicate a better transfer efficiency.

The evaluations was performed under a high-temperature, high-humidity environment (30° C./80% relative humidity), and the transfer efficiency evaluation was scored using the following criteria after the 3,000 prints of the aforementioned image had been output.

The toner density was measured using a "504 Spectrodensitometer" (X-Rite, Incorporated).

Evaluation Criteria

A: the transfer efficiency is at least 98%

B: the transfer efficiency is at least 95%, but less than 98%

C: the transfer efficiency is at least 92%, but less than 95%

D: the transfer efficiency is at least 89%, but less than 92%

E: the transfer efficiency is less than 89%

Evaluation 3: Low-Temperature Fixability

A color laser printer (HP Color LaserJet 3525dn, Hewlett-Packard) was prepared by removing the fixing unit, and the toner was removed from the cyan cartridge and the toner to be evaluated was loaded in its place.

Then, using the loaded toner, an unfixed toner image (toner laid-on level: 0.9 mg/cm$^2$) with a length of 2.0 cm and a width of 15.0 cm was formed on a receiving paper (HP Laser Jet90, Hewlett-Packard, 90 g/m$^2$) at the region 1.0 cm from the upper edge with respect to the paper feed direction.

The externalized fixing unit was then modified to enable adjustment of the fixation temperature and process speed and this was used to run a fixing test on the unfixed image.

First, with the process speed set to 250 mm/s and operating in a normal-temperature, normal-humidity environment (23° C./60% relative humidity), the unfixed image was fixed at each temperature, starting from an initial temperature of 110° C. and increasing the set temperature sequentially in 5° C. increments.

The evaluation criteria for the low-temperature fixability are given below.

The low temperature-side fixing onset point is the lower temperature limit at which cold offset behavior (behavior whereby a portion of the toner ends up attached to the fixing unit) is not observed.

Evaluation Criteria

A: the low temperature-side fixing onset point is equal to or less than 130° C.

B: the low temperature-side fixing onset point is from 135° C. to 145° C.

C: the low temperature-side fixing onset point is from 150° C. to 160° C.

D: the low temperature-side fixing onset point is from 165° C. to 175° C.

E: the low temperature-side fixing onset point is at least 180° C.

Evaluation 4: Heat-Resistant Storability 5 g of each particular toner was placed in a 50-mL polyester cup; this was held for 3 days at temperature=55° C./relative humidity=10%; and the presence/absence of clumping was then checked and was evaluated using the following criteria.

Evaluation Criteria

A: clumps are not produced

B: slight clumping is produced and is broken up by light shaking

C: slight clumping is produced and is broken up by lightly pressing with a finger D: clumps are produced and are not broken up even by lightly pressing with a finger E: completely clumped The results of the evaluations of the toner properties are given in Table 3.

TABLE 3

| | Evaluation 1 | | Evaluation 2 | | Evaluation 3 | | |
|---|---|---|---|---|---|---|---|
| | Image density | rank | Transfer efficiency | rank | Low temperature-side fixing onset point temperature ° C. | rank | Evaluation 4 |
| Example 1 | 1.60 | A | 99% | A | 120 | A | A |
| Example 2 | 1.52 | A | 98% | A | 125 | A | B |
| Example 3 | 1.56 | A | 97% | B | 135 | B | A |
| Example 4 | 1.45 | A | 99% | A | 125 | A | B |
| Example 5 | 1.54 | A | 96% | B | 155 | C | A |
| Example 6 | 1.45 | A | 98% | A | 125 | A | C |
| Example 7 | 1.53 | A | 96% | B | 140 | B | A |
| Example 8 | 1.59 | A | 94% | C | 160 | C | A |
| Example 9 | 1.36 | B | 93% | C | 120 | A | A |
| Example 10 | 1.40 | B | 98% | A | 120 | A | C |
| Example 11 | 1.29 | C | 93% | C | 135 | B | A |
| Example 12 | 1.40 | B | 97% | B | 155 | C | A |
| Example 13 | 1.35 | B | 99% | A | 120 | A | C |
| Example 14 | 1.58 | A | 98% | A | 125 | A | A |
| Example 15 | 1.48 | A | 99% | A | 120 | A | B |
| Comparative Example 1 | 1.14 | D | 89% | D | 125 | A | C |
| Comparative Example 2 | 1.33 | C | 91% | D | 160 | C | D |
| Comparative Example 3 | 1.32 | C | 93% | C | 175 | D | A |
| Comparative Example 4 | 1.30 | C | 97% | B | 130 | A | D |
| Comparative Example 5 | 1.41 | B | 95% | B | 180 | E | A |
| Comparative Example 6 | 1.39 | B | 94% | C | 185 | E | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-214303, filed Nov. 7, 2017, and Japanese Patent Application No. 2018-171955, filed Sep. 13, 2018, which are hereby incorporated by reference herein in their entirety.

What is claimed is:

1. A toner comprising: a toner particle that contains a binder resin and a wax, wherein:

the binder resin contains a styrene-acrylic copolymer;

the content of the styrene-acrylic copolymer in the binder resin is at least 50 mass %;

the wax contains a wax A;

at least 15.0 mass parts of the wax A compatibilizes at 100° C. with 100 mass parts of a styrene-butyl acrylate copolymer, which is a copolymer of 75 mass parts of styrene monomer and 25 mass parts of butyl acrylate monomer and has a weight-average molecular weight of 30,000; and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 μm, and the ratio of r1 to r2 is from 1.0 to 3.0.

2. The toner according to claim 1, wherein, using SPw and SPc, respectively, for the solubility parameters of the wax A and the styrene-butyl acrylate copolymer and using Mw for the weight-average molecular weight of the wax A, the SPw, SPc, and Mw satisfy the relationship in the following formula (1), wherein the unit for the solubility parameters is $(cal/cm^3)^{1/2}$:

$$(SPc-SPw)^2 \times Mw \leq 680 \quad (1).$$

3. The toner according to claim 1, wherein the styrene-acrylic copolymer contains at least one copolymer selected from the group consisting of styrene-alkyl acrylate ester copolymers and styrene-alkyl methacrylate ester copolymers, and the number of carbons in the alkyl group in the alkyl acrylate ester and the alkyl methacrylate ester is from 2 to 10.

4. The toner according to claim 1, wherein the wax A contains an ester wax of a diol and an aliphatic monocarboxylic acid.

5. The toner according to claim 1, wherein the wax A contains an ester wax of a diol having from 2 to 6 carbons and an aliphatic monocarboxylic acid having from 14 to 22 carbons, and the ester wax has a solubility parameter of at least 8.83 $(cal/cm^3)^{1/2}$.

6. The toner according to claim 1, wherein the wax further contains a hydrocarbon wax.

7. A toner comprising: a toner particle that contains a binder resin and a wax, wherein:

the binder resin contains a styrene-acrylic copolymer;

the content of the styrene-acrylic copolymer in the binder resin is at least 50 mass %;

the wax contains an ester wax of a diol having from 2 to 6 carbons and an aliphatic monocarboxylic acid having from 14 to 22 carbons;

the ester wax has a solubility parameter of at least 8.83 $(cal/cm^3)^{1/2}$; and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 μm, and the ratio of r1 to r2 is from 1.0 to 3.0.

8. A method for producing a toner comprising a toner particle that contains a wax and a binder resin containing a styrene-acrylic copolymer, wherein:

the steps of producing the toner particle include either step (i) or step (ii) below;

(i) a step of forming, in an aqueous medium, particles of a polymerizable monomer composition containing the wax and a polymerizable monomer that can produce the binder resin containing a styrene-acrylic copolymer, and polymerizing the polymerizable monomer present in the particles of the polymerizable monomer composition, and (ii) a step of forming, in an aqueous medium, particles of a resin solution obtained by dissolving or dispersing the wax and the binder resin containing a styrene-acrylic copolymer in an organic solvent, and removing the organic solvent present in the particles of the resin solution, the content of the styrene-acrylic copolymer in the binder resin is at least 50 mass %;

the wax contains a wax A;

at least 15.0 mass parts of the wax A compatibilizes at 100° C. with 100 mass parts of a styrene-butyl acrylate copolymer, which is a copolymer of 75 mass parts of styrene monomer and 25 mass parts of butyl acrylate monomer and has a weight-average molecular weight of 30,000; and in a cross section of the toner particle observed using a scanning transmission electron microscope, domains of the wax are present, the average number of the domains is from 20 to 2,000, and using r1 for the average major diameter of the domains and r2 for the average minor diameter of the domains, r1 is from 0.03 μm to 1.00 and the ratio of r1 to r2 is from 1.0 to 3.0.

9. The toner production method according to claim 8, wherein, using SPw and SPc, respectively, for the solubility parameters of the wax A and the styrene-butyl acrylate copolymer and using Mw for the weight-average molecular weight of the wax A, the SPw, SPc, and Mw satisfy the relationship in the following formula (1), wherein the unit for the solubility parameters is $(cal/cm^3)^{1/2}$:

$$(SPc-SPw)^2 \times Mw \leq 680 \quad (1).$$

10. The toner production method according to claim 8, wherein the styrene-acrylic copolymer contains at least one copolymer selected from the group consisting of styrene-alkyl acrylate ester copolymers and styrene-alkyl methacrylate ester copolymers, and the number of carbons in the alkyl group in the alkyl acrylate ester and the alkyl methacrylate ester is from 2 to 10.

11. The toner production method according to claim 8, wherein the wax A contains an ester wax of a diol and an aliphatic monocarboxylic acid.

12. The toner production method according to claim 8, wherein the wax A contains an ester wax of a diol having from 2 to 6 carbons and an aliphatic monocarboxylic acid having from 14 to 22 carbons, and the ester wax has a solubility parameter of at least 8.83 $(cal/cm^3)^{1/2}$.

13. The toner production method according to claim 8, wherein the wax further contains a hydrocarbon wax.

* * * * *